US005771805A

United States Patent [19]

Branas et al.

[11] Patent Number: 5,771,805

[45] Date of Patent: Jun. 30, 1998

[54] ROTATING PRINTING MACHINE

[75] Inventors: Jose Branas, Rue; Daniel Rota, Lausanne, both of Switzerland

[73] Assignee: Bobat SA, Lausanne, Switzerland

[21] Appl. No.: 797,568

[22] Filed: Feb. 7, 1997

[30] Foreign Application Priority Data

Feb. 9, 1996 [CH] Switzerland ..... 00334/96

[51] Int. Cl.[6] ..... B41J 13/14

[52] U.S. Cl. ..... 101/248; 101/183; 101/216

[58] Field of Search ..... 101/181, 183, 101/216, 248

[56] References Cited

U.S. PATENT DOCUMENTS

| | | | |
|---|---|---|---|
| 3,742,850 | 7/1973 | Sedlak | 101/248 |
| 4,137,845 | 2/1979 | Jeschke | 101/248 |
| 4,414,898 | 11/1983 | Westerkamp et al. | 101/248 |
| 4,484,522 | 11/1984 | Simeth | 101/248 |
| 4,604,083 | 8/1986 | Barny et al. | 493/34 |
| 4,606,269 | 8/1986 | Jeschke et al. | 101/248 |
| 4,709,634 | 12/1987 | Momot et al. | 101/248 |
| 4,782,752 | 11/1988 | Etchell | 101/248 |
| 5,092,242 | 3/1992 | Knauer | 101/248 |

FOREIGN PATENT DOCUMENTS

| | | | |
|---|---|---|---|
| 0 352 483 | 1/1990 | European Pat. Off. | 101/248 |
| 0 154 836 | 6/1990 | European Pat. Off. | 101/248 |
| 0 262 298 | 5/1992 | European Pat. Off. | 101/248 |
| 0 401 656 | 4/1994 | European Pat. Off. | 101/248 |
| 0 621 133 | 10/1994 | European Pat. Off. | 101/248 |
| 0 644 048 | 3/1995 | European Pat. Off. | 101/248 |
| 0 689 277 | 12/1995 | European Pat. Off. | 101/248 |
| 0 693 374 | 1/1996 | European Pat. Off. | 101/248 |
| 0 699 524 | 3/1996 | European Pat. Off. | 101/248 |
| 2 380 137 | 9/1978 | France | 101/248 |
| 2 541 179 | 12/1987 | France | 101/248 |
| 27 20 313 | 1/1987 | Germany | 101/248 |

OTHER PUBLICATIONS

"SYNAX—Decentralized system for synchronizing machine axes" *Mannesmann Rexroth* Catalog No. 71–201 IEN, Sep. 1994 and No. 71 201 IDE, Sep. 1994.

*Primary Examiner*—Edgar S. Burr
*Assistant Examiner*—Steven S. Kelley
*Attorney, Agent, or Firm*—Hill & Simpson

[57] ABSTRACT

A rotating printing machine comprises several printing stations with each station having a printing form cylinder being driven directly by an asynchronous vectorial electric motor controlled by an electronic circuit for monitoring and control of the angular position at a command value that changes over time and is received from a electronic calculating station for the synchronization of the stations with one another. Each of the printing cylinders has an axle connected to the axle of the rotor of the adjacent motor and the axle of the cylinder and motor can be moved in an axial translation for the correction of lateral registration of the printing forms of the cylinder. The machine includes an arrangement that reads the registration marks printed by each station and establish the possible lateral and longitudinal registration errors for each station, each lateral error is applied to the electrical control circuit of the electrical motor of the corresponding station to control the axial position of the common axle of the cylinder and rotor assembly and each longitudinal error is added directly to the cylinder position command of the corresponding station.

8 Claims, 3 Drawing Sheets

ROTATING PRINTING MACHINE

BACKGROUND OF THE INVENTION

The present invention is directed to a rotating printing machine for strip elements or plate elements and, more particularly, to a polychrome or multi-color printing machine comprising several stations for printing primary colors, which colors are superposed in order to produce a final image. Each station of the machine has a pressure or support cylinder coacting with a form or printing cylinder that works together with an inking cylinder and a transfer cylinder to print an image on a sheet, web or strip of material passing between the support cylinder and printing cylinder.

European 352 483 describes a printing machine in which all of the supporting cylinders are driven by a separate drive train engaged with the first mechanical shaft driven by a first electric motor, and all of the printing cylinders are driven from a second mechanical shaft driven by a second electrical motor. These two motors are controlled by a central digital calculating station that adapts the angular velocity of the shaft of the printing cylinders to the case in which their diameter does not correspond to that of the support cylinders and, thus, avoids the necessity of exchanging them.

Nonetheless, this type of driving by means of one or two shafts equipped with angle gear mechanisms or drive trains is rather costly. The precision of this driving is likewise limited, all the more so since a jolt in one of the stations will be reflected in the other stations. In addition, this driving can easily be set into vibration due to its own weak mechanical frequency.

U.S. Pat. No. 4,604,083, whose disclosure is incorporated herein by reference thereto and which claims priority from the same Swiss Application as French Reference 2 541 179, describes a machine for making flexible boxes from sheets of cardboard, in which a printing section with four printing groups is positioned between an upstream introduction section and downstream sections for notching, cutting and folding the printed blank and then subsequently delivering the blank. A DC motor drives the lower and upper transporters of each of the printing groups, of which the form or printing cylinders are individually driven by four DC motors. The regulation of the longitudinal registry among the printing groups is obtained by acting electronically on the angular position of each of these motors. The form or printing cylinders of each printing group is constructed to also be laterally displaceable, in order to align the printing of different groups therebetween. In order to do this, each of the printing cylinders is mounted on bearings which permit a lateral displacement of the cylinder under the action of separate lateral displacement motors.

The machine of this U.S. Patent has an arrangement for driving each of the DC drive motors consisting of a command group, comprising a command generator circuit and a circuit for synchronization by motor, a calculating group made up of a microprocessor with input/output circuits, a signal processing group comprising a component for determining the direction of and for multiplication of impulses coming from impulse generators for each of the DC drive motors as well as processing circuits for interphasing and transformation of the signals coming from the first and second groups and a command logic group made up of a logical circuit for selection of the driving and of a logical circuit for selecting manual commands.

This arrangement realizes, between the DC drive motors, a virtual electric synchronization shaft for the printing group by fastening them on a master general sheet driving motor, from which it receives the electrical impulses from an encoder. This arrangement notably realizes the verification of the concordance between the program values and the effective state of the components of the machine, with a pre-positioning of the motors upon a change of the task or after breakage of the electrical shaft connecting them. The execution of the angular corrections of the motors can be obtained by pushing buttons or by units for controlling the registry of the sheets. The execution of the lateral corrections is obtained by acting on the lateral drive motors and by monitoring of the correct operation of the different motors.

Though already more precise, this machine is nonetheless handicapped by the disadvantages inherent to DC motors. For example, the DC motors' awkwardness due to the necessarily large diameter, regular maintenance of the sliding contact permitting looping-in of the rotor circuits in conventional machines, or the cost in the case of what is called a "brushless" motor, due to the fact that it is necessary to bake large magnets onto the rotor in order to constitute or provide the poles.

A recent development, sold under the tradename "SYNAX" and illustrated in the September 1994 catalog of the electric motor manufacturer MANNESMANN REXROTH, consists of the use of asynchronous electric control motors called "vectorial". The vectorial has electrical circuits for monitoring and controlling the angular position of the motor, which are connected, by a transmission loop to a central electronic calculating station for synchronization of the stations among themselves. This station assigns to each control circuit a "volatile" position command value, for example one that changes with the desired velocity of the machine.

A primary point of interest of the asynchronous motors is that they are less expensive to purchase and to maintain, due to the fact that their rotors comprise only large turns, short-circuited to themselves.

The main point of interest of asynchronous motors is the remarkable precision of the output torque, and thereby the velocity and of the angular position obtained by means of a "vectorial" control, in which the supplying of the stator occurs by means of a voltage undulator by acting on the frequency and the amplitude of the stator voltage. Alternatively, in place of a controlling of the stator frequency, a controlling of the phase of the stator voltage occurs in relation to the rotor flux and permits a more rapid response to be obtained.

Usefully, the position commands are transmitted from the central calculating station to the control circuits in a digital fashion along a loop of optical fibers. This transfer is particularly insensitive to the electromagnetic perturbations present in the work area.

In addition, angular encoders are known and are provided for mounting at the end of the rotating axle for generating a sinusoidal output signal, whose interpolation permits the determination of the angular position of the axle as close as $1/2{,}000{,}000$ of a millimeter. Thus, the regulation effected by a control circuit, whose negative feedback loop receives the signal from the encoder of this type, permits the occurring of a synchronization precision of less than 0.005 angular degrees, which corresponds for a printing cylinder with a standard diameter on the order of 800 mm to a peripheral error of 0.07 mm, which is well below the positioning error of 0.10 mm standardly tolerated in printing.

It can thus be proposed to connect the output axle of the vectorial asynchronous motor directly with the axle of the form or printing cylinder to enable a suppression of all standard reducing couplings, which always have an elastic play that disturbs the transmission of the torque and of the position. More preferably, it is proposed to realize an axle common to the rotor of the motor and to the printing cylinder. This axle is of a large diameter and hollow in order to optimize the relation between the torque transmission rigidity and the rotational inertia.

In addition, and as mentioned in the description of the machine with DC motors, it is important to be able to correct, in the course of production, the position of the printing cylinder dependent on the position of the others, when the corresponding printing turns out to no longer be correctly registered. When the error is in the direction of travel of the element, this is called a "longitudinal" error, and it is appropriate to modify the peripheral position of the printing cylinder or form and, thus, the angular position of the corresponding cylinder. If the error is transversal, this is called a "lateral" error, and it is appropriate to displace the printing cylinder on its axle.

U.S. Pat. No. 5,092,242, whose disclosure is incorporated herein by reference thereto and which corresponds to European 401 656, describes, for example, an arrangement for driving and regulating a printing cylinder and its support cylinder, which arrangement is situated at only one side of the machine. In this arrangement, the driving torque of the cylinder is transmitted by three toothed wheels or gears with helical teeth in series. The second gear is mounted freely in rotation on the axle of the printing cylinder by means of a bearing. Next to the first helical gear, a double-toothed gear presents a toothed collar with a spur toothing that engages with the toothed gear, likewise with the spur toothing, mounted rigidly on the axle of the printing cylinder. The lateral registry is thus obtained by advancing or drawing back the axle of the printing cylinder, which has no effect on the velocity of rotation of the cylinder, due to the spur toothing and the floating second wheel. The peripheral registry is effected by displacing the double-toothed wheel parallel to the axle and, thus, the first helical gear in relation to the second, which advances or draws back the peripheral position of the printing cylinder in relation to the support cylinder.

U.S. Pat. Nos. 4,782,752; 4,709,634, which corresponds to EP 262 298; 4,606,269, which corresponds to EP 154 836; and 4,137,849, which corresponds to French 2 380 137, whose disclosures are incorporated herein by reference thereto, and German 27 20 313 specify other equivalent arrangements whose mechanism for correcting longitudinal and lateral registry include a gearing with helical gears and another with spur gears. The corrections are capable of being made separately, manually or remotely by means of electrical motors. Incidentally, the use of the gearings permits the insertion of a reducer that reduces the required power of the motor and likewise divides the necessary resolution of the subsequent correcting calculations by the value of the factor of reduction.

Nonetheless, these known double-correction arrangements require the presence of gear reduction arrangements interposed between the driving motor and the axle of the printing cylinder. The function of this reducer is modified dependent on the correction desired by a mechanism of correcting rods, cams and levers acting on one or the other of the gears or on this or that support bearing of the cylinder axle. In addition, these complex arrangements are expensive to obtain. These arrangements also cause significant inertia forces, which must be overcome either manually or with the help of powerful motors, which inertia forces slow down the placing into effect of the correction. In addition, the unavoidable wear of the pieces over time induces mechanical play in the arrangement, which will alter the precision of the correction.

These effects thus considerably reduce the advantage of the use of sophisticated electrical motors, particular asynchronous motors with high-precision vectorial control. For machines using this type of motor, there thus remains a complex controlling of the longitudinal registry using travelling cylinders for the modification of the strip tension between two stations and no lateral correction is provided.

SUMMARY OF THE INVENTION

The object of the present invention is to provide a printing machine based on vectorial asynchronous motors that directly drive the printing cylinders which receive the printing forms and also the support cylinders, if desired. This machine additionally comprises means for double-correction, either manual or automatic, of the longitudinal and lateral registration of the printing forms, foregoing any reduction mechanism interposed between a motor and the printing cylinder.

This correction means must be as precise as possible, for example must react effectively beginning with very small errors, in a dynamic manner, for example, with a very short response time. To accomplish this, the device must, first of all, have components whose structures are at once rigid, in order not to induce errors by elasticity, and are simple, in order to accordingly reduce the costs of construction. These components must also be able to be assembled without play or with simple compensation in order to be able to transmit adequate corrective forces in a precise manner.

These objects are achieved in a rotating printing machine in which the printing cylinder of each printing station is driven directly by a vectorial asynchronous electric motor controlled by an electronic circuit for monitoring and controlling of the angular position at a command value that changes over time and is received from a central electronic calculating station for the synchronization of each station with other stations, with each of the printing cylinder axles being fixed in prolongation of or being common with the axle of the rotor of its motor, due to the fact that the cylinder, axle, motor assembly of at least one station can be moved in axial translation in relation to the chassis of the machine and to the stator of that motor for the correction of the lateral registration of the printing forms of the printing cylinder.

It is known to an electrical engineer that the displacement of a rotor in relation to its stator induces substantial modifications in the internal electromagnetic fluxes, and will result in a modification of the mechanical torque at the exit in a way that is hardly predictable. However, the vectorial asynchronous motors are, in fact, known that are rather elongated, for example in the order of 500 mm, while the range of displacement necessary in order to effect the lateral correction is only 10 mm. Trials in the workshop have shown that slight variations in flux can thus be entirely eliminated by the monitoring and control circuit of the asynchronous motor.

Advantageously, the printing cylinders of all the stations are movable in translation with their associated rotor, and the machine has an arrangement that reads registry marks printed by each station and establishes the possible lateral and longitudinal registry error for each station. Then, each lateral error is applied to the electronic control circuit of the electric motor of the corresponding station that controls, by means of a mechanism, the axial position of the axle for the rotor and cylinder assembly, and each longitudinal registry error is added directly to the cylinder position command of the corresponding station.

As soon as it is possible to forego the introduction of gearing mechanisms for the axial displacement of the printing cylinder in such a way as to preserve a direct rigid connection between the cylinder and its rotor, only a fine and dynamic longitudinal correction is justified by direct action of the asynchronous motor in association with a lateral correction. This proves to be particularly advantageous for printing machines with strip elements, in which, in addition to the heavy correction mechanisms, it is likewise possible to do away with the travelling cylinders for controlling registration by modification of the tension of the strip.

According to the preferred embodiment, an angular encoder is mounted at one end of each rotor and cylinder assembly in order to generate a signal representing the angular position of the axle, which signal is applied to the feedback loop of the monitoring and control circuit of the corresponding asynchronous motor. The housing of the annular encoder is connected to the chassis of the machine by means of a fastener that is angularly rigid but permits it to follow the axial displacements of the axle.

Notably, the angular fastener for the encoder can comprise a plurality of lamellae in the form of parallel coaxial extending collars, which are connected to one another by diametric pairs of mounting devices, with the mounting devices connecting one pair of collars being offset 90° from the next adjacent mounting device connecting the next collar.

The control of the angular position of the cylinder is thus particularly improved when the monitoring and control circuit is provided with feedback information of the momentary angular position of the given axle by means of an angular encoder mounted directly on the axle, but only insofar as this information is reliable. In order to do this, it has first of all also proved preferable to maintain the encoder in relation with the axle, and not fixed to the chassis. Notably, the fastener according to the invention ensures an axial displacement of the encoder for the following of the axle without effort by the housing and also a very high torsional rigidity, which is an important condition for the correct reading of the angular position. Above all, the inventive angular fastening arrangement for the encoder avoids the necessity of displacing the assembly of the asynchronous motor with the cylinder, which would have constituted a mass too great to permit the realization of fine dynamic lateral corrections.

Advantageously, the common axle of the rotor and the cylinder is mounted on needle bearings, and it comprises a protruding flange grasped by a fork displaced axially by an endless screw extending parallel to the axle and driven by an electric motor for lateral correction. It is thus preferable that the flange or the fork comprises a first ball bearing or bearing with a cylinder for the reduction of frictional forces and for taking up play. In addition, the fork is also guided through a second bearing along a support axle. The endless screw is, for example, connected to the motor by a reduction mechanism comprising a pinion and a gear or a pinion connected to a pulley by means of a timing belt.

This displacement mechanism for the axle of the rotor and cylinder assembly proves to be relatively simple to obtain, while assuring a precise displacement by means of the reducer connecting the motor to the endless screw and by means of the firm mounting of the fork by means of bearings for taking up play along a rigid axle, on the one hand, and in the grasping of the flange of the axle, on the other hand.

Advantageously, the end of the axle at the side opposite the motor is held by a movable bearing. Thus, the printing cylinder is fixed on the axle by clamping of two end hubs of the cylinder between a first cone fixed at the side of the motor and a second, opposed, movable cone that can be pushed in the direction of the first by a mechanical means, for example by a nut engaged on an external threading provided at the end of the axle.

When the printing cylinder has to be exchanged for another cylinder of a different diameter in order to be better adapted to the size of the subsequent series, the axle remains stationary and, thus, only the cylindrical envelope provided with the two end hubs is exchanged. This operation is considerably easier than the previous exchanging of the cylinder with its axle and its gears, because the new assembly is much lighter and can be attached to a stationary axle that guides the installation. The clamping into position of the cylinder is simple and rapid. In addition, the encoder is then preferably placed at the end of the axle at the motor side, in order to leave space free for the changing of the cylinder and, incidentally, so as to not be falsified by possible residual parasitic torsions of the axle.

Other advantages and features of the invention will be readily apparent from the following description of the preferred embodiments, the drawings and claims.

DESCRIPTION OF THE PREFERRED EMBODIMENTS

Figure 1:
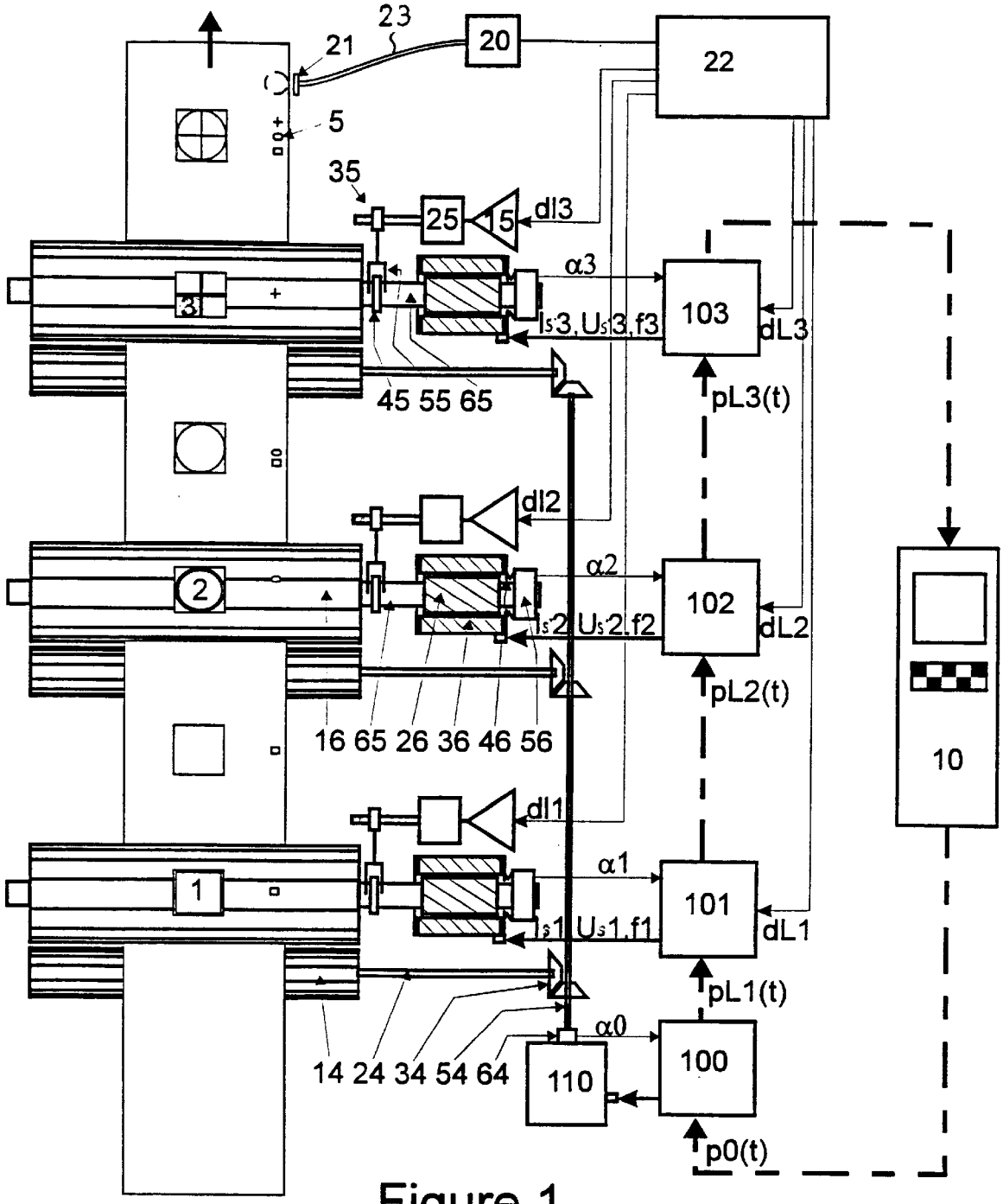
FIG. 1 is a schematic illustration of a machine according to the present invention.

The principles of the present invention are particularly useful for a machine which has a plurality of printing stations, such as three printing stations 1, 2 and 3, for printing on a strip element 4, which passes successively through the three stations. Each of the stations comprises a printing cylinder 16 for supporting the printing forms facing a support cylinder 14, which is positioned below the printing cylinder. In the example shown, these stations successively deposit a square impression, a circular one and a cross-shaped one, which are intended to be precisely superposed on one another.

In the machine that is shown, all the axles 24 of the support cylinders 14 are mechanically connected to one drive shaft 54, which extends along the machine from upstream to downstream in the printing stations. The coupling of these axles 24 to the support cylinders 14 is realized by means of an angular gear arrangement 34, which has conical beveled gears. the shaft 54 is driven by an electric motor 110, which is controlled by a first electronic circuit 100 for monitoring and controlling the angular position. The angular position $\alpha 0$ of the shaft 54, which will reflect the advance of the strip 4, is read by an encoder 64, which represents this angular position, and applies it in a feedback loop to the circuit 100.

In addition, each of the printing cylinders for the printing plates or printing forms of each of the stations 1, 2 and 3 is mounted directly on an output axle 65 of an electric motor, for example the rotor 26 of the motor is constructed on the same end of the axle, while the stator 36 is firmly attached to the chassis or frame of the machine. In this case, the diameter of the axle 65 is relatively large, on the order of 50 mm to 80 mm, in order to transmit large torques without elastic deformation, but the axle is also hollow in the center to reduce the moment of inertia. These motors are preferably asynchronous AC motors controlled by an electronic circuit for the monitoring and control of the angular position, which circuits are identified as 101, 102 and 103 for each of the three stations.

In this machine, all of the monitoring and control circuits 100–103 are connected by a network looped with a central calculating unit 10. This unit 10 has a keyboard for the entry of commands and instructions, a microprocessor, a plurality of memories containing programs and management data, which depend on the characteristics of the machine, and a screen for viewing entered parameters and/or data applied at the output of the loop. Preferably, this transmission loop is made of a coaxial cable of optical fibers, with a first conductor connecting the output of the central unit 10 to the control circuit 100 of the motor for driving the assembly of the support cylinders, a second conductor connecting the circuit 100 to the circuit 101 for controlling the motor of the first station, a third conductor connecting the circuit 101 to the circuit 102 for controlling the motor of the second station, a fourth conductor connecting the circuit 102 to the circuit 103 for controlling the motor of the third station and, finally, a fifth conductor ensuring the return loop to the central calculating unit 10.

On this transmission loop, there travels command information for the position of each of the motors at a given moment t:, respectively, p0(t), representing the desired angular position of the motor 110 and, thus, the shaft 54 and thereby all of the support cylinders 14 defining the advance of the strip 4, as well as the values pL1(t), pL2(t) and pL3(t), representing the desired angular position, respectively, of the motors for the stations 1, 2 and 3, and, thus, the corresponding printing cylinders. Each command value is established by the calculating unit 10 so as to take into account the length of the machine, notably the intervals between the stations, the size of each block possibly arranged on the cylinders of different diameters, in such a way as to ensure a rigorous synchronization of the stations among themselves so that the printings are correctly superposed to give a high-quality final image. These position commands are "volatile", for example they change over time, depending on the desired velocity of production of the machine.

There is thus realized, in place of a traditional mechanical shaft parallel to the shaft 54, a virtual electric synchronization shaft in which all the motors of the machine are individually slaved to the central calculating station 10.

In addition, in each station, an angular encoder 56 delivers a signal $\alpha$1, $\alpha$2, $\alpha$3, which signals represent the momentary angular position of the corresponding rotor 26 and, thus, the position of the printing cylinder as soon as it is acknowledged that the axle 65 is sufficiently rigid through its dimension. In each station, the signal generated by the encoder 56 is applied in a feedback loop of the corresponding electrical monitoring and control circuit 101, 102 and 103.

These identical monitoring and control circuits 101–103 directly supply the stators of their corresponding motors with tri-phased alternative electric energy, characterized, respectively, by the stator intensity values Is1–Is3, crest-to-crest voltage amplitude values of Us1–Us3 and frequency values f1–f3.

Figure 2:
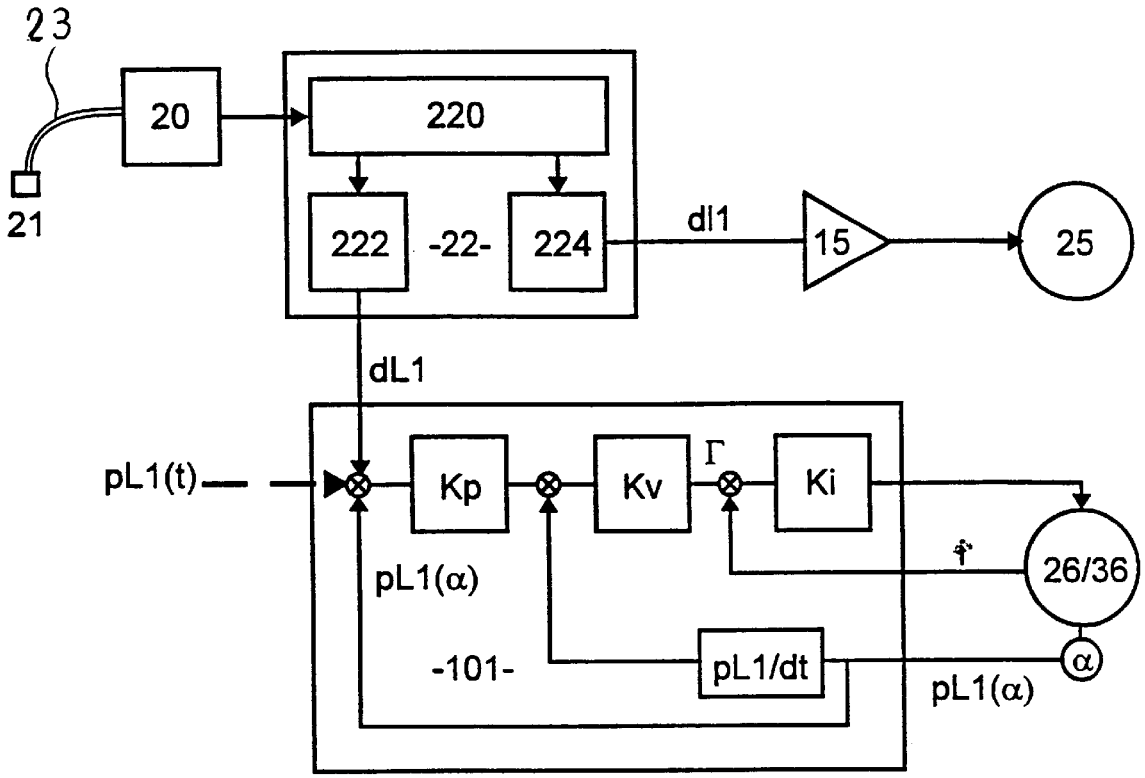
FIG. 2 is a schematic diagram of an arrangement for correcting lateral and longitudinal errors in a printing station of the machine.

The lower part of FIG. 2 shows the schematic diagram of a monitoring and control circuit 101. This circuit 101 comprises a first sub-assembly for controlling torque G, which comprises a circuit Ki that generates the stator electrical energy Is1, Us1 and f1, as well as a feedback loop for reading either the intensity by phases or the flux for the establishment of possible error of correction.

Such torque control circuits Ki for asynchronous motors are known. For example, U.S. Pat. No. 3,824,437, whose disclosure is incorporated herein by reference thereto, describes a circuit in which the magnetic field is measured in the air gap, and the stator current is measured. The measured stator current is transformed into two components of stator current in quadratures, oriented in relation to the measured magnetic field. One of the components of the stator current in quadratures is regulated proportionally to the command amplitude of the total effective flux of the rotor at a constant level fixed by a constant reference input quantity, corresponding to the command amplitude of the total effective flux of the rotor. The other component of the stator current in quadrature is varied with a second reference or command quantity applied at the input and proportional to the command torque of the asynchronous motor. Another command process of an asynchronous motor is specified in Russian Patent Document 193 604 and consists of a phase-by-phase regulation of the momentary phase currents of the stator of an asynchronous motor by comparing the commands in the momentary phase current measurements of the stator, varying the stator current with the sum in quadrature of two components of stator current, of which one is constant and corresponds to the constant magnetic flux to be achieved, and the other is variable as a function of the command variable corresponding to the command torque of the asynchronous motor. At the same time, the frequency of the stator current is varied with the sum of the two frequencies, of which one is that of the rotation of the rotor and the other is subjected to the variations of the command torque.

The monitoring and control circuit 101 additionally comprises a velocity control loop based on the signal pL1($\alpha$) emitted by the angular encoder 56. This signal is derived in time in the feedback loop in order to obtain an effective velocity information, which is compared with the command value in order to establish the possible error and then to control the velocity in the circuit kV, which is placed in series with the torque circuit Ki.

In fact, in the inventive machine, it is especially desirable to ensure a position command. For this purpose, the information pL1($\alpha$) emitted by the encoder 56 is likewise compared to the command signal pL1(t) received from the optical fiber transmission loop, in order to establish a possible position error, and then to control the position in the circuit Kp, which is placed in series with the velocity control circuit Kv. Thus, the angular position of the output axle 65 of the motor approximately reflects the command value applied at the input.

Figure 3:
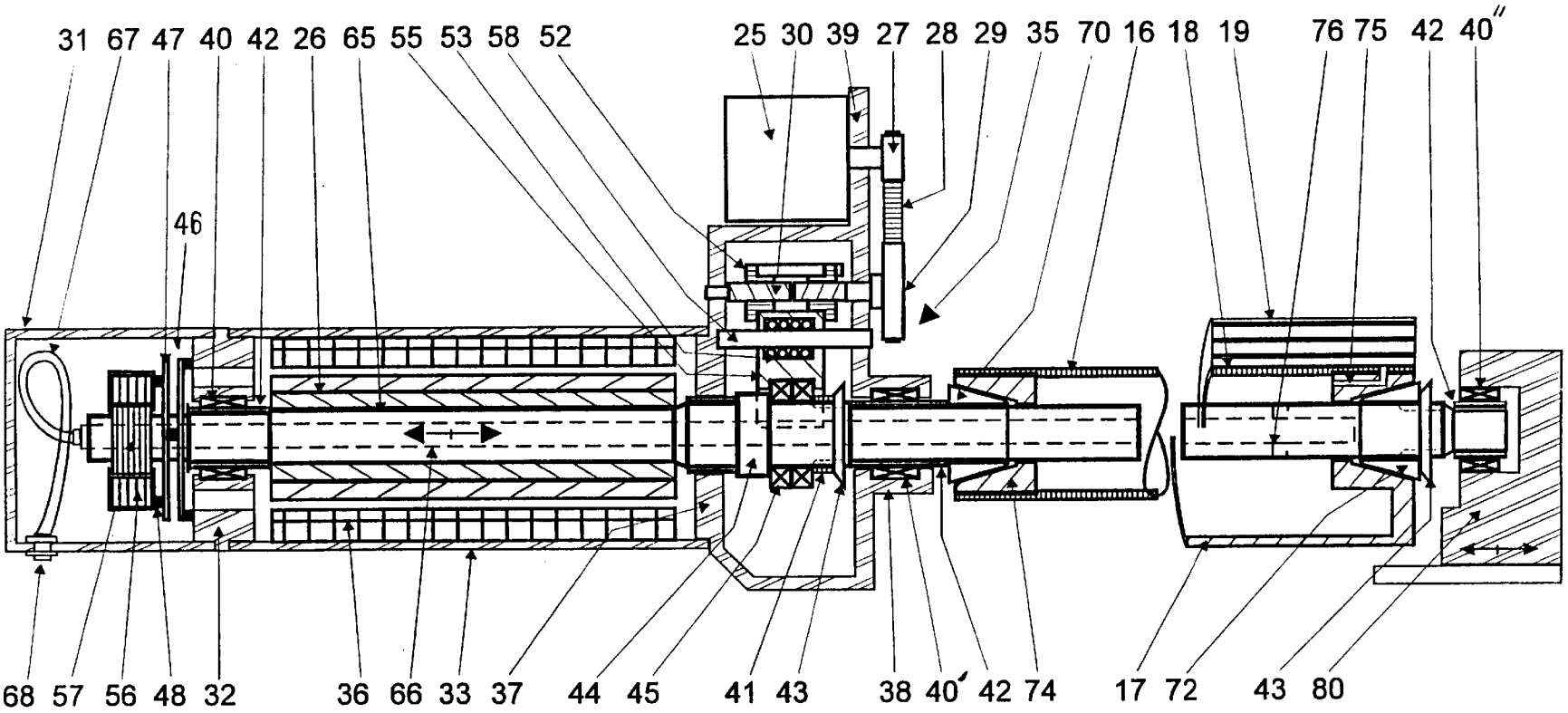
FIG. 3 is a longitudinal cross sectional view of an electric motor connected with the printing cylinder in a printing station of the machine.

More particularly according to the invention, and as can be better seen from FIG. 3, the axle 65 is freely mounted in rotation on rollers or needle bearings 40, 40' and 40", which likewise enable axial displacement when desired. This axial displacement carries, on the one hand, the rotor 26 and, on the other hand, the printing cylinder 16. More precisely, these bearings are in contact with the axle 65 through friction rings 42. The first bearing 40 is installed in a seating or mount 32 situated at the rear of the stator 36 of the motor and fixed to the chassis 37 of the machine by the casing 33 of the electric motor. The second bearing 40' is located between the electric motor and the printing cylinder 16 and, more precisely, is installed in a collar 38 fixedly attached to the chassis 37. The third bearing 40" is, for its part, installed at the other end of the axle 65 and of the cylinder 16, in a block 80 of the chassis that is capable of being displaced in a direction parallel to the axle in order to disengage that end.

As shown in FIGS. 1 and 3, the axial position of the axle for the rotor-cylinder assembly 26/65/16 is applied by a fork 55 engaged with a flange 45 that protrudes from the axle 65. The fork 55 can be displaced parallel to the axle 65 by a mechanism 35 driven by a synchronous step-by-step motor 25, which motor itself is controlled by an electronic control circuit 15.

More precisely, the flange 45 is made up of two bearings crimped on the axle 65 and pushed against a shoulder 44 of this axle by a nut 43 threaded on external threadings of the axle. The nut-pushing effect is through a separating ring 41, which leaves free access to the fork 55.

Due to consideration of rigidity, the fork 55 is itself mounted through a ball bearing 53 to move along a support axle 58, which is mounted in the chassis 37 parallel to the axle 65. The fork is guided in axial translation by a cart 52, which is in two parts, and engaged with a double endless screw 30. the adjustment of the grasping of the two parts of the cart 52 enables the elimination of any residual play. The end of the endless screw 30 carries a pulley 29 driven by a timing belt 28 engaged with the output pinion 27 of a step-by-step motor 25, which is mounted rigidly on an upper flange 39 of the chassis 37.

It will be noted that this assemblage can be realized in a very rigid manner. The precision of the displacement of the fork 55, and thus the axle 65, is obtained, on the one hand, by the pitch of the micrometric screw 30 and, on the other hand, by the relation of the diameter of the pulley 29 to the pinion 27.

In addition, the angular encoder 56 is mounted at the rear of the motor at the end of the axle 65. More particularly, the fastener 46 of the encoder housing to the fixed mount 32 is such to permit an axial displacement of this housing so that it will always remain in exact correspondence with its rotating internal mechanism 57, which is fixedly attached to the axle 65 but holds this housing rigid in a precise, fixed angular position in relation to this mount 32.

Figure 4:
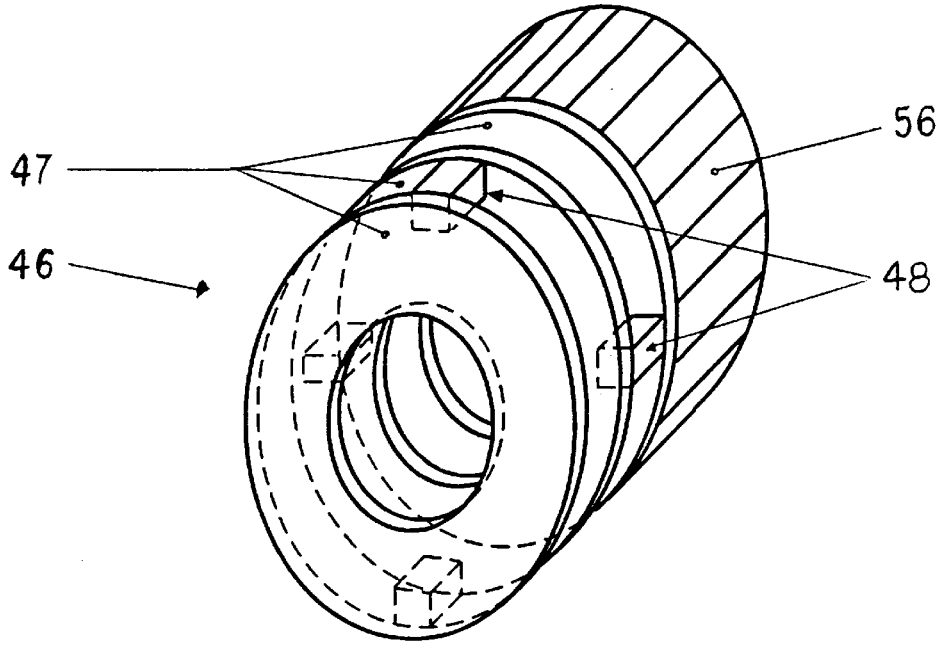
FIG. 4 is a perspective view of the fastener for an angular encoder to the chassis of the machine.

In order to do this, and as best seen in FIGS. 3 and 4, this fastener 46 is made up of a plurality of lamellae in the form of concentric collars 47, with adjacent collars being connected to one another by diametric pairs of fixing means 48. The diametric pair between two lamellae are offset at right angles relative to the following diametric pair. Since these lamellae are thin, they are flexible in the axial direction, on the one hand, and the collar shape of these lamellae prevent any rotation in relation to the central axle. The encoder is protected by the covering 31, which is fixed to the seating 32.

The inventive printing machine additionally includes an arrangement or means for locating marks printed on the edge of the strip by each of the stations. This locating enables the detection of a possible longitudinal and lateral registry errors of one or the other of the printed images. As shown in FIGS. 1 and 2, the marks 5 pass under an optical reading head 21 that focuses a beam of light transmitted by a first part of a bundle of optical fibers 23. The reflected light is read by the reading head 21 and is conducted by a second part of the optical fiber 23 to a photosensitive element 20, which generates electrical signals that are applied to a registry control unit 22.

The registry control unit 22, as illustrated in FIG. 2, comprises a processing circuit 220 for processing and a selection of signals, which it directs either to a circuit 222 for calculating longitudinal error or to a circuit 224 for calculating lateral error. The circuit 222 comprises three output lines, permitting the application of a signal representing the longitudinal error dL1 to the monitoring and control circuit 101 of the first station, and, in an analogous fashion, to apply the signal representing the registry errors dL2 and dL3 to the monitoring and control circuits 102 and 103, respectively, of the corresponding other stations. In parallel fashion, the circuit 224 for the calculation of lateral error comprises, among other things, three outputs enabling the application of a signal representing the error in the lateral registry dl1 to a preamplification and control circuit 15 of the motor 25 of the first station. In parallel fashion, the signals dl2 and dl3, representing the lateral errors, are applied to corresponding correction motors 25 of the stations 2 and 3.

Thus, if a lateral registry error of one of the stations is detected by the control unit 22, the corresponding correction signal dl(i) triggers the rotation in one direction or the other of the relevant motor 25, which advances or draws back the fork 55, and, thus, moves the axle 65 with its printing cylinder to correct the lateral position of the faulty printing cylinder.

The range of correction of the lateral error is commonly ±5 mm. In holding an asynchronous motor that is rather elongated, for example with active parts of the length on the order of 500 mm, it is to be noted that the displacement of the rotor in relation to the stator due to a lateral correction remains less than 1% of the total length, which causes only very slight change in the flux, which is moreover rapidly eliminated by the electronic monitoring and control circuit 10(*i*). In addition, this displacement due to a lateral correction of registry has no influence on the precision of the reading of the angular encoder 56, thanks to its special mounting 46, which thus enables the pursuit of a correct functioning of the monitoring and control circuit of the vectorial asynchronous motor.

On the other hand, this rigorous respecting of the proper functioning of the piloting of the asynchronous motor thus allows it to be used only for the correction of the longitudinal error, as well. Referring to FIG. 2, the longitudinal error signal dL1 is directly added in the addition of the control signal pL1(t) and of the feedback signal pL1($\alpha$) at the input of the monitoring control circuit 101. This registry error dL1 is then simply and spontaneously processed, as if it were, in fact, only an error detected by the negative feedback. The asynchronous motor accelerates and/or slows down slightly during a revolution, in order to set itself back in relation to the advance of the strip 4 as imposed by the rotation of the support, pressure or counter-cylinders 14. A new registry mark is then read by the reading head 21. If the circuit 22 detects a residual error, it reapplies a smaller corrective adjustment dL1' for the following revolution.

In order to facilitate and accelerate this registry control, it is preferable to overdimension the power of the asynchronous motor up to a value between 4 kW and 5 kW. In addition, the installation of the motor, in direct engagement with and close to its printing cylinder, enables a corresponding reduction of the intermediate parasitic torsional vibrations, with the result that practically a totality of the correction is transmitted instantaneously.

For certain printing sizes, it proves useful to exchange the form or printing cylinder for one with a different diameter. Rather than using an axle 65 with several sections attached by bolted flanges, such as is currently used, it has proved preferable to maintain the integrity of this axle through the entire length of the machine. In order to install a new cylinder, only a cylindrical envelope fixed in an immovable manner is required. In this connection, with reference to FIG. 3, the cylinder 16 is, in fact, formed by a light, rigid cylindrical envelope which is made of aluminum, at the ends of which there are fixed, by soldering or other means, two hubs 74. These hubs have inwardly-directed conical concave central cavities.

The axle 65 is thus provided with a first cone 70 with a fixed position. For example, this first cone 70 is supported on the ring 42 emerging from the second roller bearing 40'. The end of the axle opposite the motor thus comprises a first part with a limited diameter engaged in the bearing 40". The following part thus presents an external threading on which a nut 43 can be engaged, enabling the second mobile cone 72 to be pushed toward the first cone 70.

An exchange of the printing cylinder is thus obtained simply by disengaging the bearing 40" from the axle by withdrawing the mobile block 80. The nut 43 is then unscrewed, freeing the second mobile cone 72 and thus the cylinder 16, which can then be removed. It will then be noted that the presence of the axle 65 remains stationary and permits the guiding of the new cylinder thereon. The mobile cone 72 is reinstalled and then pushed toward the fixed cone 70 by rotating or tightening the nut 43. The hubs 74 are thus clamped between the two cones 70 and 72 to obtain a rigid connection without play. The bearing 40" is finally put into place again by advancing the block 80. Notably, since these cylinders are lighter than before, they can be handled more rapidly and more precisely. It would even be possible to automate such an exchange by means of a robot.

In addition, since these simplified cylinders are less costly to obtain, it may be desirable to keep on hand a range of basic cylinders, for example four standard diameters: 117.9 mm, 149.7 mm, 181.5 mm and 213.4 mm. This is moreover facilitated by the virtual electric shaft managed by the central unit 10 of the machine. In fact, it is thus sufficient to carry out a new calculation of the volatile position commands for the relative motor conversely to the gearing changes previously necessary to ensure concordance between the print cylinder and the support cylinder.

A sleeve of expanded material is commonly threaded on the print cylinder with a certain internal radial elasticity, and on whose rigid peripheral envelope the printing forms are effectively fixed by gluing. In order to facilitate this sleeve installation, it is useful to arrange the hollow central part of the axle 65 so as to obtain a circulation of compressed air between the exterior of the cylinder and the interior of the sleeve. More precisely, a flexible tube 67, protected by the cap 31, connects an external compressed air connector socket 68 with an internal channel 66 of the axle 65. At the end of the axle 65, this channel 66 emerges from one or several radial openings 76, which will diffuse the compressed air to the interior of the cylinder 18. The end hub can thus have one or several internal channels 75, which will permit the diffusion of the compressed air under the sleeve 19. Under the effect of this air cushion, the sleeve 19 dilates radially and, thus, enlarges its interior diameter, which eliminates all frictional forces. It is, thus, possible to use a range of sleeves with thicknesses between 2.5 mm and 66.2 mm, which are used either alone or in superposition.

The reference character 17 designates a printing cylinder with a particularly large diameter, on which the printing forms are directly glued. This configuration is useful in countries where the supply of flexible sleeves is deficient.

Although various minor modifications may be suggested by those versed in the art, it should be understood that we wish to embody within the scope of the patent granted hereon all such modifications as reasonably and properly come within the scope of our contribution to the art.

We claim:

1. In a rotating printing machine having a plurality of printing stations, each station having a printing form cylinder being driven directly by an asynchronous vectorial electric motor being controlled by an electronic circuit means for monitoring and controlling the angular position of the cylinder at a command value that changes over time and is received from the central electronic calculating station for the synchronization of each station with another, each of the printing form cylinder axles being fixed in common with the axle of the rotor of its respective motor, the improvements comprising the common axle of the cylinder and rotor assembly of each station being moved in axial translation for the correction of the lateral registry of the printing form of the cylinder, the machine having means for reading the registration marks printed by each station and establishing the possible lateral and longitudinal registration errors for each station, each lateral error being applied to the electronic circuit means of the electrical motor of the corresponding station which controls by means of a mechanism, the axial position of the common axle of the rotor and cylindrical assembly and each of the longitudinal registration errors being added directly to the cylinder position command of the corresponding station, and the machine including an angular encoder for each common axle, means for mounting the encoder at one end of each common axle in order to generate a signal representing an angular position of the axle, which signal is applied in a feedback loop of the monitoring control circuit of the corresponding asynchronous motor, the means for mounting providing an angular rigidity but permitting the encoder to follow the axle displacement of the axle, said means for mounting the encoder comprising a plurality of lamella in the form of parallel coaxial extending collars, said collars being connected to one another by diametric pairs of mounting devices which are arranged so that the pair between two lamella are oriented 90° to the next pair between the next adjacent lamella.

2. In a rotating printing machine having a plurality of printing stations, each station having a printing form cylinder being driven directly by an asynchronous vectorial electric motor being controlled by an electronic circuit means for monitoring and controlling the angular position of the cylinder at a command value that changes over time and is received from the central electronic calculating station for the synchronization of each station with another, each of the printing form cylinder axles being fixed in common with the axle of the rotor of its respective motor, the improvements comprising the common axle of the cylinder and rotor assembly of at least one station being moved in axial translation for the correction of the lateral registry of the printing form of the cylinder, the common axle for the rotor and the cylinder being mounted on needle bearings and having a protruding flange grasped by a fork, said fork being displaced axially by an endless screw extending parallel to the axle and said screw being driven by a second electric motor for lateral correction.

3. In a rotating printing machine according to claim 2, wherein one of the flange and fork has a first frictionless bearing and that the fork is guided through a second frictionless bearing along a support axle, and the endless screw is connected to the second electric motor by a reduction mechanism.

4. In a rotating printing machine according to claim 3, wherein said reduction mechanism comprises a pinion engaging a tooth gear.

5. In a rotating printing machine according to claim 3, wherein the reduction mechanism comprises a pulley connected to a pinion by a timing belt.

6. In a rotating printing machine according to claim 2, wherein the end of the common axle at a side opposite the motor is held by a movable bearing and that the printing form cylinder has two end hubs and is clamped on the axle between a first cone fixed in at the side of the motor and a second movable cone movable along the axle that can push in the direction towards the first cone to secure the cylinder on the axle.

7. In a rotating printing machine according to claim 2, which includes an angular encoder, means for mounting the encoder on an end of each common axle in order to generate a signal representing the angular position of the common axle, said signal being applied in a feedback loop of the monitoring and control circuit of the corresponding asynchronous motor, said means for mounting being connected to the chassis to provide an angular rigidity and to permit the encoder to follow the axle displacement of the axle.

8. In a rotating printing machine according to claim 7, wherein the means for mounting of the angular encoder includes a plurality of lamella in the form of parallel coaxial collars, said adjacent lamella being connected to one another by a diametric pair of mounting devices with the diametric pair between two lamella being offset by 90° from the next adjacent diametric pair.

* * * * *